United States Patent [19]

Gibert et al.

[11] 4,035,288

[45] July 12, 1977

[54] FLUIDIZED BED SEED SEPARATOR

[76] Inventors: Francois Gibert, Tour n° 4, La Feuilletiere-Villars (Loire); Gerard Champet, 16 Rue Evrard, La Talaudiere (Loire), both of France

[21] Appl. No.: 495,118

[22] Filed: Aug. 8, 1974

[30] Foreign Application Priority Data

Aug. 6, 1973 France ..... 73.29274

[51] Int. Cl.[2] ..... B03B 5/46

[52] U.S. Cl. ..... 209/466; 209/486; 209/493; 209/502; 209/505; 302/29; 198/803

[58] Field of Search ..... 209/466–469, 209/474–476, 44, 486, 490, 493, 502, 172, 172.5, 173, 470, 492, 505; 302/29; 198/25, 209; 119/57; 427/185, 213

[56] References Cited

U.S. PATENT DOCUMENTS

| | | | |
|---|---|---|---|
| 1,073,758 | 9/1913 | Hopkins | 209/492 |
| 1,285,560 | 11/1918 | Chase | 209/173 |
| 1,312,098 | 8/1919 | Cerruti | 209/173 |
| 1,508,923 | 9/1924 | Clarke | 209/173 X |
| 2,635,753 | 4/1953 | McLean | 209/466 |
| 3,065,853 | 11/1962 | Binnix | 209/468 |
| 3,087,619 | 4/1963 | Kraut | 209/486 X |
| 3,471,016 | 10/1969 | Eveson et al. | 209/474 X |
| 3,773,175 | 11/1973 | Wallace | 209/173 |
| 3,799,334 | 3/1974 | Collins | 209/11 |

FOREIGN PATENT DOCUMENTS

| | | | |
|---|---|---|---|
| 1,080,713 | 12/1954 | France | 209/466 |
| 21,545 | 9/1911 | United Kingdom | 209/492 |
| 946,480 | 1/1964 | United Kingdom | 209/470 |

*Primary Examiner*—Frank W. Lutter
*Assistant Examiner*—Ralph J. Hill
*Attorney, Agent, or Firm*—Irving M. Weiner; Pamela S. Austin

[57] ABSTRACT

A bed of fluidized material is used to separate seeds on the basis of specific gravity. The bed may be a rotating annulus and it may have one or more layers of micro-balls at the bottom. Means for rotating the annulus and various discharge means are disclosed.

18 Claims, 15 Drawing Figures

FLUIDIZED BED SEED SEPARATOR

BACKGROUND OF THE INVENTION

1. Field of the Invention

The present invention relates to a device which uses a fluidized bed for sorting bodies having different densities, such as, in particular, seeds.

2. Description of the Prior Art

It is known, when it is wanted to separate or sort products having different densities, to use devices in which several physical parameters act on the separation; all such devices are essentially based on the same principle and are mainly constituted by:

perforated grates, on which the products to be sorted are disposed, said grates being subjected to a vibration, a suction system disposed above the grate, or a blower system disposed under the grate.

The grates are inclined to the horizontal, frequently in a longitudinal direction, or sometimes in a transverse direction.

Said known devices have many drawbacks, and are only able to sort properly such products which differ greatly from each other in density. For instance, they allow suitably separating the shelled sunflower seeds from the shells, owing to the fact that the latter are very light and can be removed easily. On the other hand, these known systems are ineffective for sorting, for instance, seeds when it is necessary to separate:

the shells (the density of which is close to that of the fruits), the shelled fruits, and the unshelled seeds.

Since a few years, it is also known to use fluidized bed systems for separating the products as a function of their densitites. This procedure is being used, in particular, for coal-sorting.

According to said method, a thin layer of particles is disposed on a gas-permeable support, and an upward gas stream is caused to pass through said support and said layer, which results in the layer of particles being fluidized. The products to be sorted are poured in the bed thus obtained.

These latter systems have many drawbacks, and up to now it has not been possible to use them in industries such as that of the oil seeds, as the technical problems for working out such systems are very complex if it is wanted to maintain a fluidized bed which is stable with time and has a substantial height.

SUMMARY OF THE INVENTION

A device according to the invention to sort bodies having different densities by floating them in a fluidized bed of solid particles is characterized in that the diffusing means is constituted by a bed of micro-balls contained in an enclosure and carried by the porous bottom of the latter, said bottom lying above a space supplied with gas under pressure, while at least one paddle wheel rotates about a horizontal axis and dips into the particles of the fluidized bed, the lower paddles of said wheel being each constituted by a comb, the spacing of the teeth of which is greater than the average size of the particles of the fluidized bed, but smaller than the average size of the kind of bodies to be separated.

According to another feature of the invention, the enclosure is constituted by a U-shaped gutter which is open upwards and moves forward in longitudinal direction to cause the fluidized bed of particles to pass in succession:

under a feeding spout which discharges in bulk the bodies to be sorted, under a first paddle wheel which picks up those bodies which float on the surface of the fluidized bed, under a second paddle wheel, the paddles of which penetrate to the bottom through the fluidized bed, and picks up the densest bodies of the initial mixture to be sorted.

According to another feature of the invention, the device includes at least one additional paddle wheel, which is received between the first and the second paddle wheels, the paddles of said additional wheel entering the fluidized bed to a depth between that reached by the first paddle wheel and that reached by the second paddle wheel.

According to another feature of the invention, the U-shaped enclosure is closed on itself so as to define an annular gutter which is rotatably driven about its vertical axis by centering means and driving means, in a manner such as to form a "roundabout" machine, the fluidized bed of which travels in succession:

under a feeding spout which discharges the bodies to be sorted, under at least a first paddle wheel, the comb-shaped paddles of which enter the fluidized bed to a small depth in order to pick up the lightest bodies, under at least a second paddle wheel, the comb-shaped paddles of which enter the fluidized bed more deeply to pick up the densest bodies, again under the feeding spout in order to start a new cycle, and so on.

According to another feature of the invention, the rotary annular spout is supported by several bodies, each of which includes:

at least one centering roller which has a vertical axis, and runs on one of the side walls of the gutter, at least one carrying roller with a horizontal axis, on which the U-shaped bottom of the gutter runs and rests.

According to another feature of the invention, the device includes at least one driving roller, which runs on the wall of the annular gutter, against which it is kept applied by elastic return means.

According to another feature of the invention, each paddle wheel has an annular side face against which a driving roller runs, the fixed support of said roller being adapted to take up an adjustable position with respet to the axis of the paddle wheel, so that, with a driving roller which rotates at a constant speed, it is possible to vary the speed of rotation of the paddle wheel continuously.

According to another feature of the invention, the elements of the diffusing means are balls which have all the same diameter, such as steel balls 1 mm in diameter.

According to a modification of the invention, the element of the diffusing means are:

a first kind of big balls having all the same diameter (for instance, steel balls 1 mm in diameter), a second kind of small balls having all the same, definitely smaller, diameter (for instance, steel balls 0.10 mm in diameter).

According to a further modification of the invention, the diffusing means is constituted by superposing several layers of balls, the balls in each layer having all the same diameter, but the diameters of the balls decreasing progressively from the lower layers to the upper layers (for instance, steel balls the diameters of which are:

1 mm in the layers at the bottom of the gutter, 0.6 mm in the next upper layers, 0.4 mm in the layers which overlie said next upper layers, 0.2 mm in those upper layers which define the top of the fluidized bed).

According to another feature of the invention, longitudinal grooves are provided on the opposite inner walls of the U-shaped gutter.

According to another feature of the invention, the device includes at least one paddle wheel which turns about a co-axial fixed cylinder which is provided with an opening at its upper part, while an Archimedean screw is rotatably integral with said wheel and innerly tangential to said cylinder, so that the bodies picked up from the fluidized bed by the paddle wheel are discharged into said cylinder, and carried away by the Archimedean screw in a direction parallel to the axis of the paddle wheel.

According to a modification of the invention, the device includes at least one paddle wheel for the lightest bodies, the paddles of said wheel being shaped as flat combs and sweeping the inner surface of a coaxial fixed cylinder portion, the latter being open and tangentially extended — at its lower part, and in the upstream direction of the travel of the fluidized bed — by a horizontal flat floor, said floor and the lower part of said cylinder portion being constituted by parallel blades, the mutual spacings of which are greater than the average size of the particles of the fluidized bed, but smaller than the smallest size of the lightest bodies, so that said bodies are likely to be carried along by the paddles along the inner surface of the cylinder portion, the speed of rotation of the wheel being adjusted so that the linear speed of forward motion of the fluidized bed and the tangential speeds of the ends of the blades are substantially equal and in the same direction in the area where the wheel meets the bed.

According to a further modification of the invention, the device includes at least one paddle wheel for the densest bodies, each paddle of said wheel being provided with a blade at its end, the paddle and the blade being constituted by a series of L-shaped parallel blades, the mutual spacings of which are greater than the average size of the particles of the fluidized bed, but smaller than the smallest size of the densest bodies.

According to a further modification of the invention, there is provided, near to the lower part of the bed, above the diffusing means and upstream of at least one paddle wheel for picking up the denses particles at the bottom of the fluidized bed, a fixed horizontal ramp which is supplied with compressed air to produce a sheet of air in the upstream direction, the angle of incidence of said sheet of air on the upper surface of the diffusing means is of the order of a few degrees, so that the densest products spin inside the fluidized bed and are picked up by the wheel.

According to another feature of the invention, the enclosure is integral with an air generator constituted by a blower, the turbine of which is coaxial with the vertical axis of rotation of the enclosure and driven by a fixed engine to the output shaft of which it is connected by a bolt drive, said turbine being housed inside a stator contained in the space between the two central horizontal plates of the enclosure, said space opening at its periphery into the space lying below the porous bottom of the enclosure for supplying the latter with compressed air.

According to another feature of the invention, there are provided at least two concentrical circular baffles which are integral with either of the inner surfaces of the central horizontal plates of the enclosure, so that the air zigzags from the center between said plates, whereby its pressure is suitably distributed.

According to another feature of the invention, the central horizontal plate is provided with ports adapted to be obturated, the extent of obturation of said ports adjusting the air flow.

The accompanying drawing, which is given by way of non-limiting example, will allow a better understanding of the features of the invention.

DETAILED DESCRIPTION OF PREFERRED EMBODIMENTS OF THE PRESENT INVENTION

Figure 1:
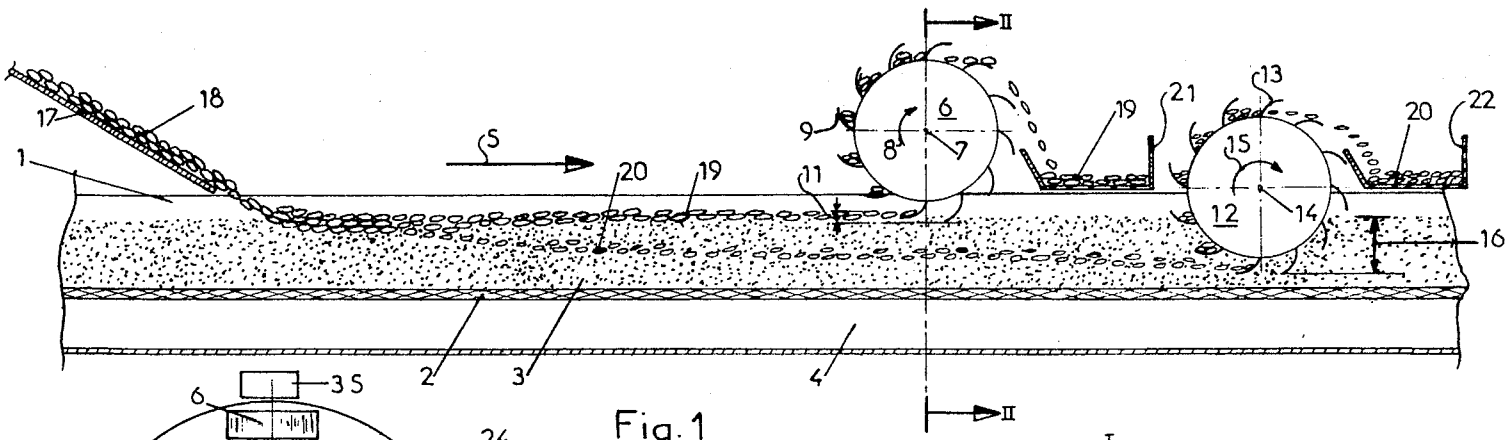
FIG. 1 is a longitudinal section, along line I—I of FIG. 2, of a sorting device according to the invention.
Figure 2:
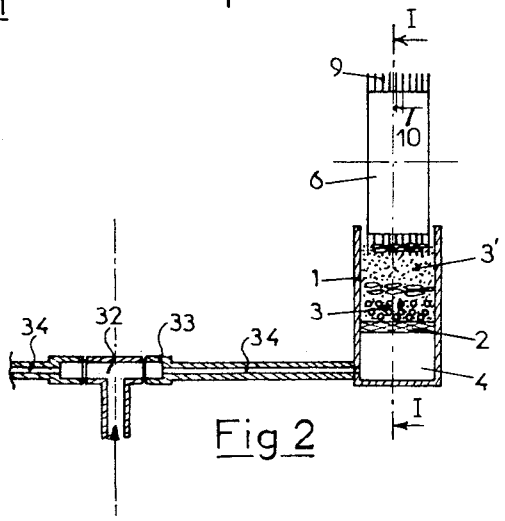
FIG. 2 is a transverse section along line II—Ii of FIG. 1.

FIGS. 1 and 2 show an enclosure 1 in the shape of a U-shaped gutter, the opening of which is directed upwards.

Near the bottom of said gutter there is a porous wall 2, which may be a wire cloth of a perforated plate. A layer or "mattress" 3 of micro-balls rests on said wall 2, and will constitute the diffusing means. A lower space 4 is defined below the porous wall 2 on the bottom of the enclosure 1, which space is continuously supplied with a gas under pressure. This gas may merely be compressed air.

The wall 2 and the layer 3 constitute together a diffuser for the air coming from the lower space 4.

The enclosure 1 is given a longitudinal forward motion in the direction of the arrow 5.

The assembly passes under a first paddle wheel 6, which turns about a fixed axis 7, in the direction of the arrow 8. The paddles 9 of said wheel are constituted each by juxtaposed curved teeth. In other words, each paddle 9 is in the shape of acomb, the teeth of which are spaced by a distance (FIG. 2). Said gap 10 is greater than the diameter of the particles of the fluidized bed 3'.

The teeth of the paddles 9 dip into the bed 3' to a depth 11 (FIG. 1).

Downstream of the wheel 6 another similar wheel 12, which is provided with incurved paddles 13, turns about a fixed axis 14, in the direction of the arrow 15. During their rotation the paddles 13 dip into the bed of particles 3' to a depth 16 greater than the depth 11.

Forward of the wheel 6, a feeding spout 17 discharges the products 18 to be sorted (such as, for instance, shelled palm nuts).

These products include elements having at least two different densities, to wit:

elements 19, the density of which is less than the apparent density of the bed 3', elements 20, which are denser than the particles of the bed 3'.

Immediately after falling into the fluidized bed 3', the products 18 divide, through floating, into two layers, that of the light elements 19 floating on the bed 3', and that of the heaver alements 20 falling inside said bed 3'.

If care has been taken to select for the wheel 6 a teeth interval 10 smaller than the average size of the elements 19, it will be seen that the latter will be picked up by the paddles 9, which discharge them into a container 21.

On the other hand, the elements 20 pass under the wheel 6 to reach the paddles 13 of the wheel 12, which pick them up. The elements 20 are then discharged into another container 22.

Rearward of the wheel 12, the particles 3' alone remain in the fluidized bed, which can be used again upon passing anew under the feeding spout.

Figure 1A:
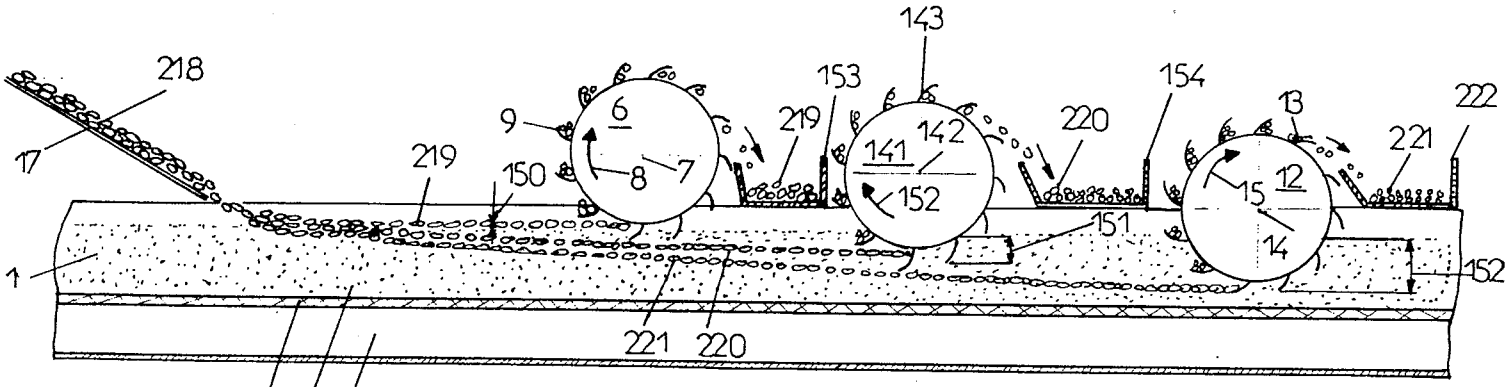
FIG. 1*a* is a longitudinal section of a sorting device with three paddle wheels according to the invention.

FIG. 1*a* depicts an alternate embodiment of the invention. The FIG. 1*a* embodiment is structurally and functionally substantially identical to the invention as shown and described in FIG. 1. A third paddle wheel 141, which turns about a fixed axis 142 in the direction of arrow 152 is disposed between paddle wheels 6 and 12. The incurved paddles 143 penetrate into the fluidized bed to a depth 151 between depth 150 of paddle wheel 6 and depth 152 of paddle wheel 12. In this embodiment the products 218 to be sorted include elements having at least three different densities including low density elements 219, medium density elements 220 and high density elements 221. The three different elements will divide as described with respect to FIG. 1 and elements 219 will be picked up by paddles 9 and discharged into container 153, elements 220 will be picked up by paddles 143 and discharged into container 154, and elements 221 will be picked up by paddles 13 and discharged into container 222, as shown in FIG. 1*a*.

Figure 3:
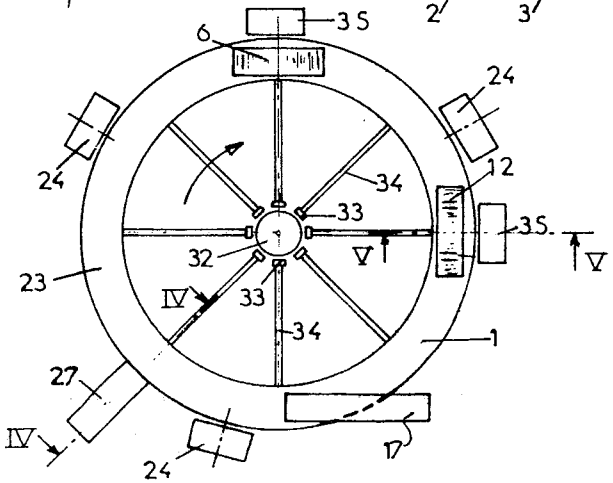
FIG. 3 is a plan view of a modification built as a "roundabout" machine.
Figure 4:
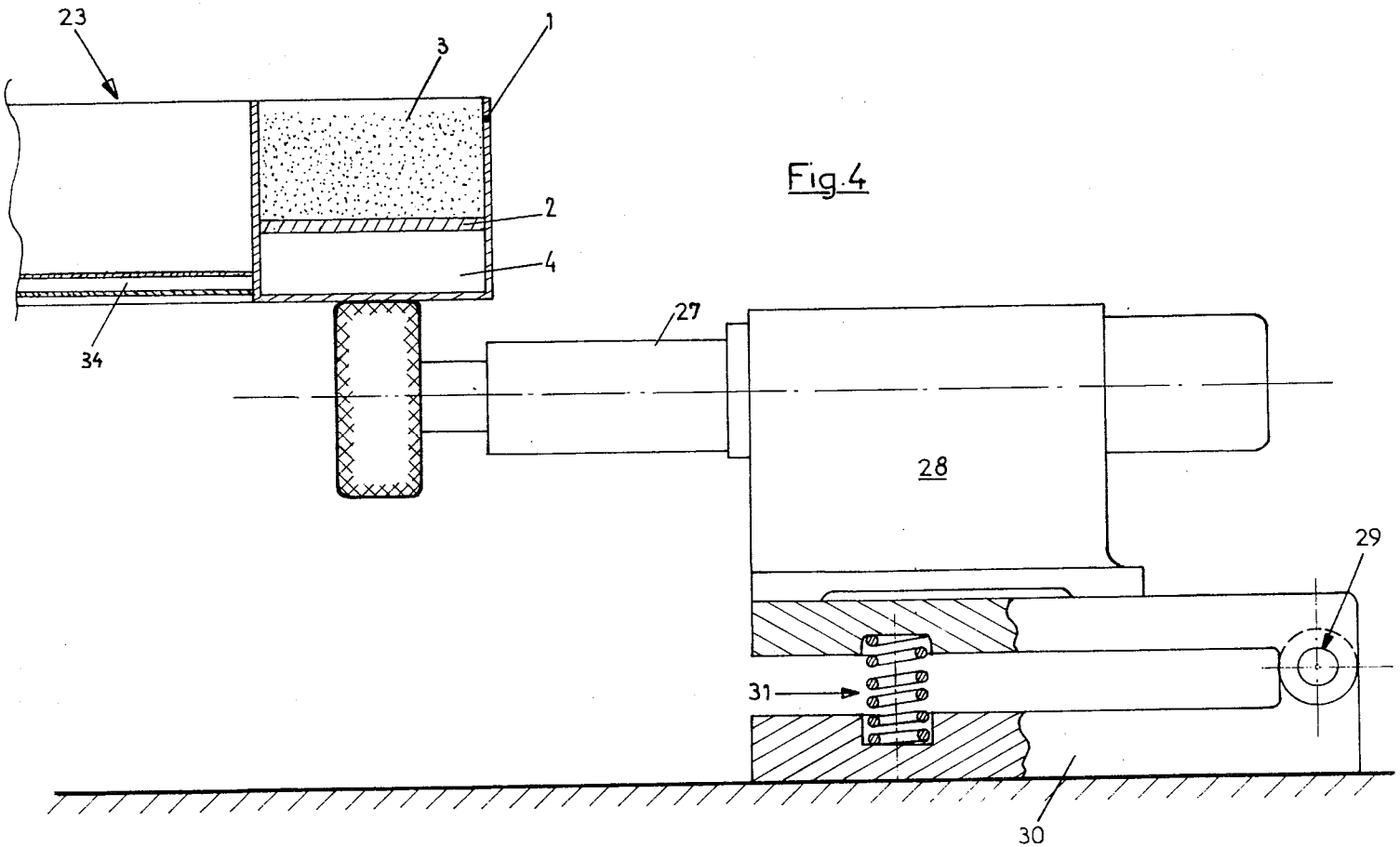
FIG. 4 is a section along line IV—IV of FIG. 3, and shows the driving roller for the roundabout.
Figure 5:
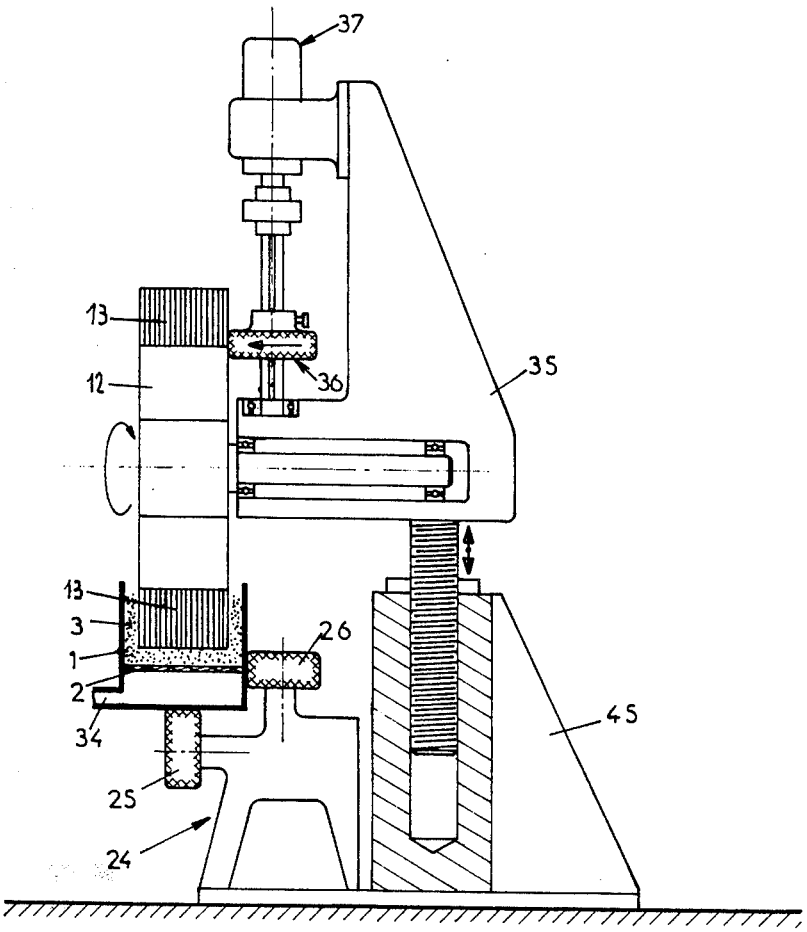
FIG. 5 is a section along line V—V of FIG. 3, and shows the driving arrangement for a paddle wheel and the centering arrangement for the enclosure of the roundabout.

FIGS. 3 to 5 show an embodiment of the device according to the invention in the shape of a "roundabout" machine. The U-shaped gutter is closed on itself according to an annular profile, so as to define a vat 23.

Said vat rests on at least three bogies such as 24 (FIGS. 3 and 5) consisting of two runners, one of which 25 runs under the lower surface of the vat and supports the masses, while the other runner, 26, runs on the outer diameter of the vat and allows centering the latter (FIG. 5).

The three bogies 24 rest directly on the ground, and allow thus dismounting the vat quickly.

A friction drive arrangement 27 (FIG. 4) rotates the vat 23 according to variable speeds. Said system includes a motor speed reducer 28 mounted on a frame pivoted at 29 to the frame 30, and is disposed directly under the vat 23. The frictional stress required for a good drive is obtained through the return spring 31 which is housed between the parts 28 and 30.

The device allowing obtaining the supply of gas to the enclosure is mounted at the center of the vat 23. This rotary distributor includes a fixed part 32 and a movable part 33 (FIG. 3). It is connected to the vat by a plurality of rigid ducts 34 which follow the radii, so that the gas flow is suitably distributed under the diffuser.

The paddle wheels which are used for recovering the seeds sorted according to the density thereof, are two in number as a minimum. The first wheel recovers the products 19 lying at the surface of the fluidized bed. The second wheel 12 recovers the products 20 lying at the bottom of the fluidized bed. The paddles of both wheels are preferably comb shaped. Consequently, one of the two wheels separates the denser products, while the other wheel separates the lighter products. This sorting device, which forms the subject-matter of the invention, will be, however highly improved if a third wheel or a fourth wheel, lying in the center of the fluidized bed, are available, which will allow recovering products the density of which is between that of the denser products and that of the lighter products. Said paddle wheels are fixed with respect to the frame, but rotate about their own axes. Each paddle wheel is mounted on a support such as 35 (FIG. 5), and is adjustable in height so as to be able to penetrate to a greater or lesser extent inside the fluidized bed. The rotation of said wheels is obtained through a friction system consisting of a rubber-covered runner 36 which runs on one of the sides of the wheel. The position of said runner with respect to the axis of the wheel is adjustable, the assembly (motor-speed-reducer 37 and wheel 12) being able to slide with respect to the frame 45, so that it is easy to obtain a wide range of speeds for the rotation of the paddle wheels. The delivery of the products treated by the machine is thus intimately connected to the speed of the paddle wheels and the vat.

Figure 6:
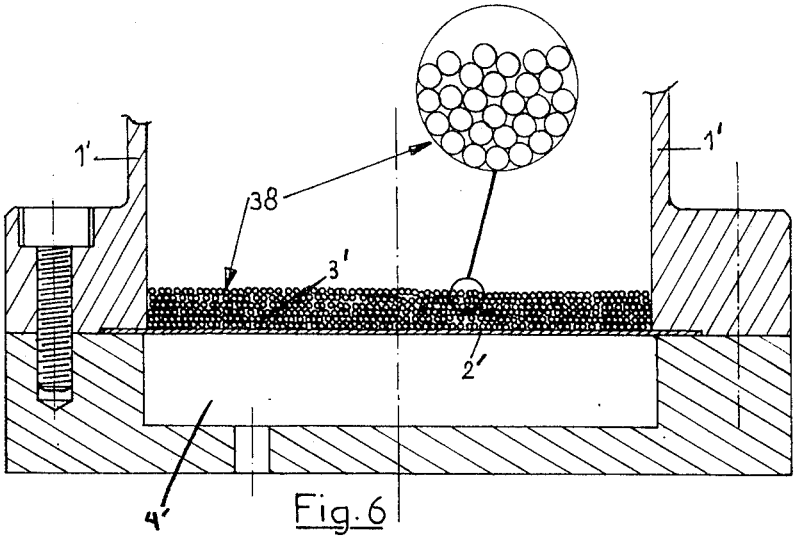
FIGS. 6, 7, and 8 show three possible embodiments of the air diffusing means used for forming the fluidized bed.

FIG. 6 illustrates a possible embodiment of the diffusing means constructed essentially as described above with respect to FIG. 1. The U-shaped enclosure 1' has disposed near the bottom thereof a porous wall 2'. A layer or mattress 3' of heavy micro-balls 38 such as steel rests on said wall or grate 2'. A lower space 4' is defined below the wall 2' on the bottom of the enclosure 1'. The function of the diffuser is essentially as described above with respect to the embodiment of FIG. 1. Experience has shown that this diffuser is highly improved when it comprises several layers of balls, the first one, that is, that resting on the grate, consisting of balls 39 with a diameter of 1 mm, the second consisting of balls 40 with a diameter of 0.55 mm, and the third consisting of balls 41 with a diameter of 0.1 mm (FIG. 8).

Figure 7:
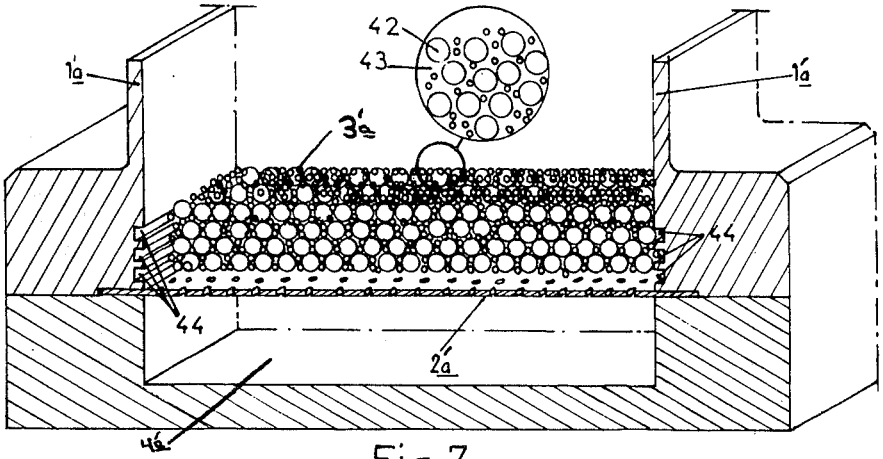
Figure 8:
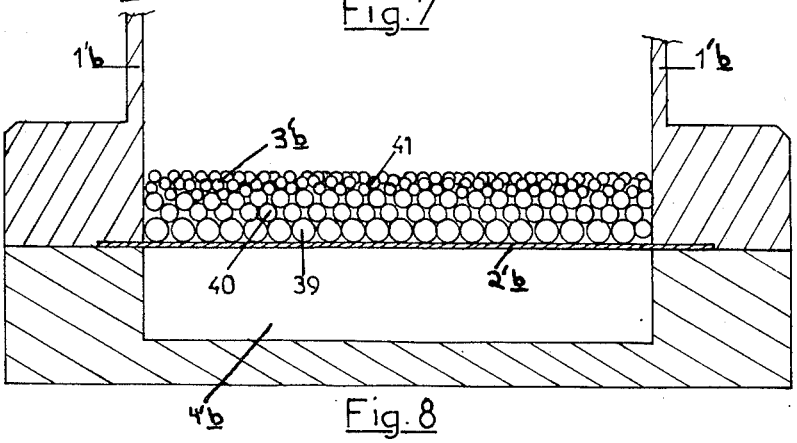

The diffusing means illustrated in FIGS. 6–8 correspond generally to the diffusing means employed with respect to the FIG. 1 embodiment. Specifically, the parts 1', 2', 3' and 4' described with respect to FIG. 6 correspond structurally and functionally to parts 1'*a*, 2'*a*, 3'*a* and 4'*a*, respectively, of FIG. 7 and parts 1'*b*, 2'*b*, 3'*b* and 4'*b*, respectively, of FIG. 8.

By varying thus the diameters of the balls, the masses thereof, and the thicknesses of the layers constituting the "mattress", it is possible to obtain a very good diffuser, and to know and vary the loss of pressure it will create for a given flow rate; moreover, this diffuser is advantageous in that it does not require any fluid-tightness or rigid fixing with respect to the working enclosure, since the reaction resulting from the pressure upstream of the diffuser is damped merely by the weight of the mattress or mattresses of balls.

In the case illustrated in FIG. 7, the mattress includes a mixture of balls 42 comparatively big (for instance, of a diameter of 1 mm) and balls 43 which are much smaller (for instance, of a diameter of 0.1 mm).

To reduce the instabilities likely to appear in the bed of particles 3' as a result of the wall effect phenomena, it may be advantageous to provide longitudinal grooves 44 (FIG. 7) in the inner vertical surfaces of the U-shaped enclosure 1'a. The existence of said grooves bring an additional loss of pressure, and prevents the gas leaks against the walls of the enclosure.

Figures 9, 10:
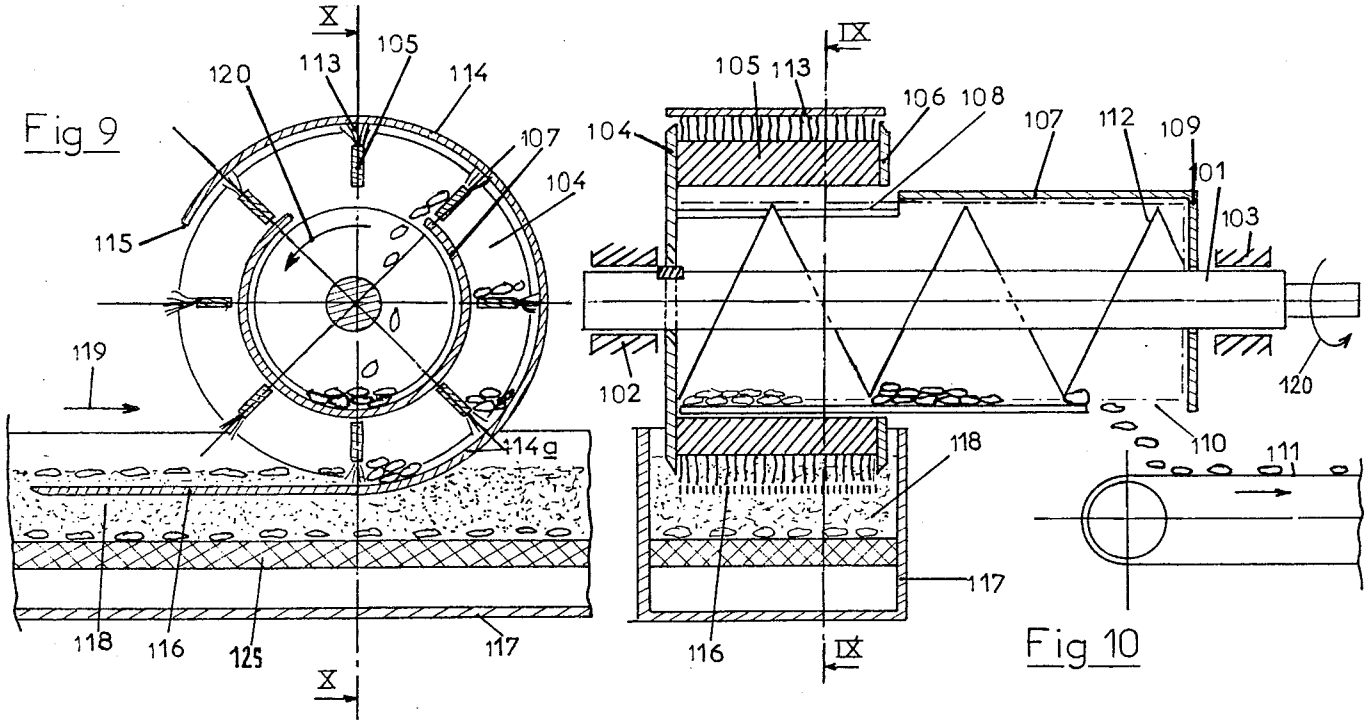
FIG. 9 is a section along line IX—IX of FIG. 10, of a paddle wheel for the lightest particles.
FIG. 10 is a section of said wheel along line X—X of FIG. 9.

According to a modification of the invention, FIGS. 9 and 10 show a paddle wheel for use in the device as essentially described above which is integral with a horizontal shaft 101 rotatably guided by two bearings 102 and 103. A side plate 104 is integral with the shaft 101 and the paddles 105 of the wheel, the other ends of the paddles being connected to a side plate 106. A part of the wheel including the paddles 105 and the side plate 106 is centrally recessed and tangential to a coaxial fixed cylinder 107. The upper part of said cylinder includes a cut 108 opposite the wheel, and projects axially beyond the wheel in the opposed direction to the side plate 104. One of the ends of said cylinder is tangential to the side plate 104, while the other is closed by a disk 109 provided with a central opening through which the shaft 101 passes. A lower cut or port 110 is provided at that end of the cylinder 107 which is adjacent to the disk 109, and opens above a belt conveyor 11. The shaft 101 is integral with an Archimedean screw 112 which is innerly tangential to the cylinder 107.

At the periphery of the wheel the paddles carry each a linear flat comb 113 which is innerly tangential to a fixed cylinder portion 114 which is coaxial to the wheel. Said cylinder 114 is provided with an opening 115, on the side of which it is extended by a horizontal floor 116 tangential to the lower part of said cylinder. Said floor 116 and a lower portion 114a of the cylinder 114 are constituted by parallel blades which are perpendicular to the axis of the wheel.

The enclosure 117 with its fluidized bed 118 is partially illustrated under the paddle wheel, the vertical axis of rotation of said enclosure lying in a direction opposed to the belt conveyor 111 in FIG. 10.

The operation is as follows:

The horizontal floor 116 is immersed at a small depth in the bed 118. The direction of forward motion of the bed is that indicated by the arrow 119, while the wheel rotates in the direction of the arrow 120. At the lower part of the wheel the tangential speed of the radial ends of the paddles is substantially equal to the speed of travel of the bed. The mutual spacings of the blades which form the floor and the portion 114a of the cylinder are greater than the average size of the particles of the fluidized bed, but smaller than the smallest size of the lightest bodies, so that said bodies are carried along by the combs 113 along the inner wall of the cylinder 114. When the paddles rise, the slopes thereof are inverted, and the bodies come then closer to the outer wall of the cylinder 107. When they reach the cut 108 in the upper part of the cylinder, they fall into the latter and gather together at the lower part of the cylinder 107, wherefrom they are carried towards the cut 110 by the Archimedean screw, the pitch direction of which has been suitably selected as a function of the direction of rotation of the wheel. They fall then on the conveyor belt 111 which carries them away.

The adjunction of a floor 116 is advantageous in that possible turbulences due to the wheel paddling in the fluidized bed are not prejudicial to the separation of the products, which are sorted as a function of the height at which they lie in the bed at that end of the floor 116 which is remote from the wheel.

Figure 12:
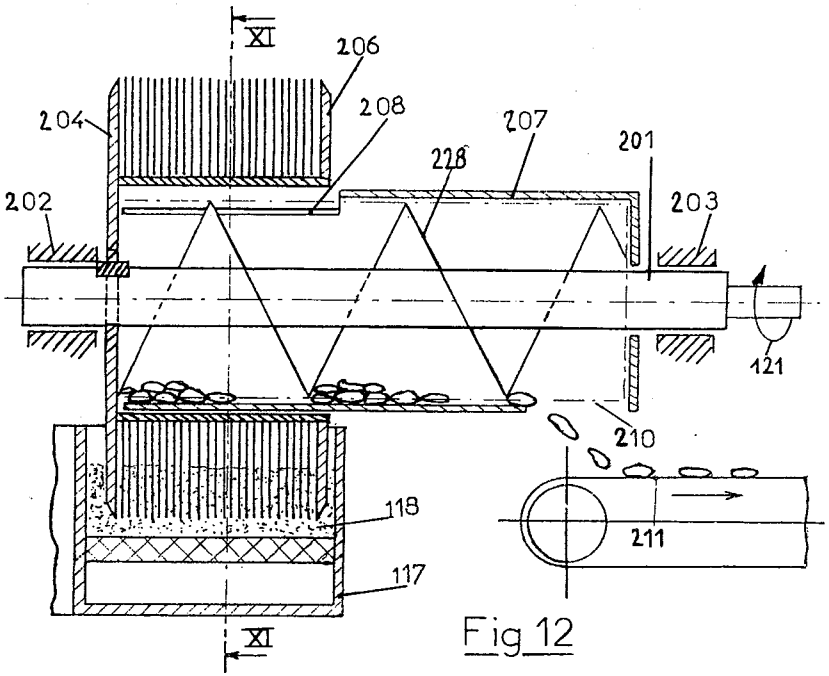
FIG. 12 is a section of said wheel, as taken along line XII—XII of FIG. 11.
Figure 11:
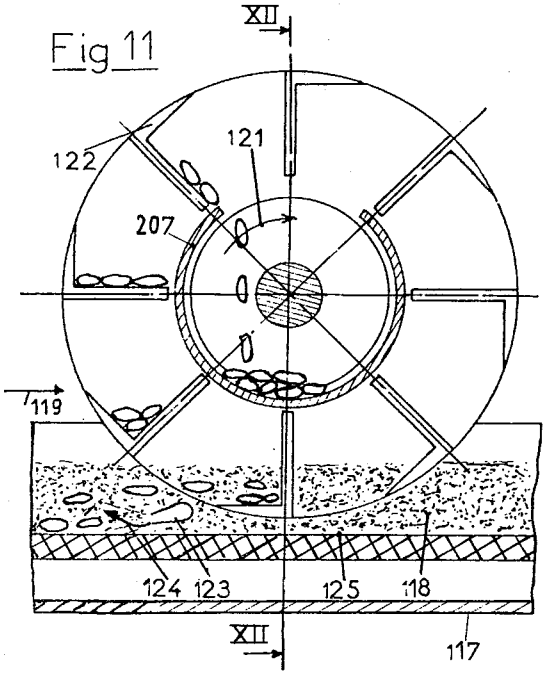
FIG. 11 is a section of a blade wheel, as taken along line XI—XI of FIG. 12.

FIGS. 11 and 12 show a wheel for use in the device as described essentially above with respect to FIG. 1 according to another modification of the invention, each paddle of which has its end provided with a blade 122, so that the paddle and blade assembly has an L-shaped straight section. This assembly is constituted by a series of parallel L-shaped blades, the spacings of which are greater than the average size of the particles of the fluidized bed, and smaller than the smallest size of the densest products. Said paddle wheel includes, as described hereinabove regarding the wheel of FIGS. 9 and 10, a cut out cylinder 207 and an Archimedean screw 212.

A fixed horizontal ramp 123 is provided near the bottom of the fluidized bed 118, upstream of the wheel in the direction of the travel 119 of the bed while the wheel rotates in the direction of the arrow 121. Said ramp is parallel to the axis of the wheel, and provided with a longitudinal slit which is oriented in a manner such that, when it is supplied with compressed, air, it produces a sheet of air 124 in the upstream direction of the wheel, the angle of incidence of said sheet of air to the upper surface 125 of the diffuser being of the order of a few degrees.

The operation is as follows (FIG. 11 and 12):

This latter wheel is more particularly intended for picking up the densest bodies, which remain then alone at the bottom of the fluidized bed. The sheet of air 124 allows detaching said bodies to enable the blades of the paddles 122 to collect them. Said bodies are then discharged, in the same way as described hereinabove, through the port 108 towards the Archimedean screw, and then through the port 210 towards a conveyor belt 211. The parts 201, 202, 203, 204 and 206 of FIG. 12 correspond functionally and structurally to the parts 101, 102, 103, 104 and 106, respectively, described hereinabove with respect to FIG. 10.

Figure 13:
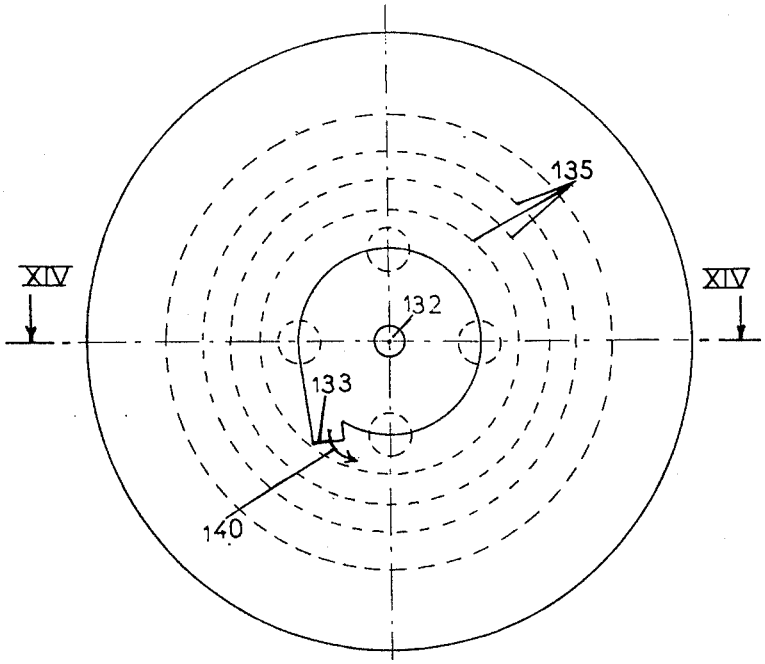
FIG. 13 is a view from below, showing an air generator incorporated to the sorting device according to an additional modification of the invention.
Figure 14:
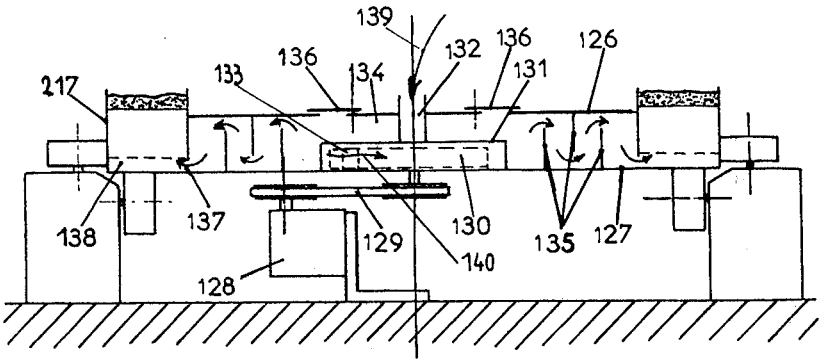
FIG. 14 is a section along line XIV—XIV of FIG. 13, and shows said air generator.

FIGS. 13 and 14 illustrate an air generator supplying air under pressure to the lower space 4 as described with respect to FIG. 1 according to a further modification of the invention. Said sorting device is constituted by a U-shaped enclosure 217 which is provided with two central horizontal plates, to wit, an upper plate 126 and a lower plate 127. A fixed engine 128 drives, through a belt 129, a blower turbine 130 which is coaxial with the vertical axis of rotation of the enclosure 217. Said turbine is guided in bearings which are integral with the enclosure, and is surrounded by a stator 131 provided with a central air inlet 132 which opens into the plate 126. A tangential outlet 133 opens into the space 134 defined between the plates 126 and 127. The inner walls of said plates are provided with concentric baffles 135. The plate 126 is provided with ports 136 adapted to be obturated and capable of connecting the central portion of the space 134 with the outside. An annular cut 137 connects the space 134 with the space 138 below the porous bottom of the enclosure.

The operation is as follows:

Starting the engine 128 enables the turbine to suck air through the port 132 in the direction of the arrow 139 to deliver it through the port 133 in a tangential direction (arrow 140). The baffles 135 ensure a good distribution of the air pressure along the annular space 138. Opening the ports 136 to a lesser or greater extent allows adjusting the air flow rate.

We claim:

1. A device for sorting bodies of different densities by floating said bodies in a fluidized bed of solid particles, comprising:

a diffuser including an enclosure having a horizontal porous bottom which serves to support thereon a fluidized bed constituted by a mattress of calibrated micro-balls contained within said enclosure;

at least one paddle wheel which rotates about suitable horizontal axis means disposed above said fluidized bed so as to permit the paddles of said paddle wheel to dip into said particles of said fluidized bed;

said diffuser being provided with suitable moving means to cause said diffuser to move forward in longitudinal direction to pass under said paddle wheel;

the lower paddles of said paddle wheel being constituted by a comb;

said comb having teeth which are spaced greater than the average size of said particles of said fluidized bed and smaller than the average size of the grade of said bodies to be separated.

2. A sorting device according to claim 1, characterized in that the enclosure is constituted by a U-shaped gutter, which is open upwards and moves forward in longitudinal direction to cause the fluidized bed of particles to pass in succession:

under a feeding spout which discharges in bulk the bodies to be sorted, under a first paddle wheel which picks up those bodies which float on the surface of the fluidized bed, under a second wheel, the paddles of which penetrate to the bottom through the fluidized bed, and pick up the densest bodies of the initial mixture to be sorted.

3. A sorting device according to claim 2, characterized in that it includes at least one additional paddle wheel which is received between the first and the second paddle wheels, the paddles of said additional wheel penetrating into the fluidized bed to a depth between that reached by the first paddle wheel and that reached by the second paddle wheel.

4. A sorting device according to claim 2, characterized in that longitudinal grooves are cut in the opposite inner walls of the U-shaped gutter.

5. A sorting device according to claim 1, characterized in that it includes at least one paddle wheel for the lightest bodies, the paddles of said wheel being shaped as flat combs and sweeping the inner surface of a coaxial fixed cylinder portion, the latter being open and having its lower part extended, in the upstream direction of the forward motion of the fluidized bed, by a horizontal flat floor, said floor and the lower part of said cylinder portion being both constituted by parallel blades, the mutal spacings of which are greater than the average size of the particles of the fluidized bed, but smaller than the smallest size of the lightest bodies, so that said bodies are carried along by the paddles along the inner surface of the cylinder portion, the speed of rotation of the wheel being adjusted so that the linear speed of forward motion of the fluidized bed and the tangential speed of the ends of the paddles are substantially equal and in the same direction in the area where the wheel meets the bed.

6. A sorting device according to claim 1, characterized in that it includes at least one paddle wheel for the densest bodies, each paddle of said wheel being provided with a blade perpendicular to its end, the paddle and the blade being constituted by a series of L-shaped parallel blades, the mutual spacings of which are greater than the average size of the particles of the fluidized bed, and smaller than the smallest size of the densest bodies.

7. A sorting device according to claim 1, characterized in that there is provided, near the lower part of the fluidized bed, above the diffuser and upstream of at least one paddle wheel for picking up the densest products from the bottom of the fluidized bed, a fixed horizontal ramp which is supplied with compressed air to produce a sheet of air in the upstream direction, the angle of incidence of said sheet of air on the upper surface of the diffuser being of the order of a few degrees, so that the densest products, which rest on the upper part of the diffuser, are detached from the latter and then picked up by the wheel.

8. A sorting device according to claim 1, characterized in that it includes U-shaped enclosure which is closed on itself so as to define an annular gutter which is rotated about its vertical axis by centering means and driving means, so as to form a "roundabout" machine, the fluidized bed of which passes in succession:

under a feeding spout which discharges the bodies to be sorted;

under at least a first paddle wheel, the comb-shaped paddles of which enter the fluidized bed to a small depth in order to pick up the lightest bodies therefrom;

under at least a second paddle wheel, the comb-shaped paddles of which enter the fluidized bed more deeply to pick up the densest bodies therefrom;

again under the feeding spout to start a new cycle, and so on.

9. A sorting device according to claim 8, characterized in that the rotary annular gutter is carried by several bogies, each of which includes:

at least one centering roller, which has a vertical axis and runs against one of the side walls of the gutter;

at least one carrying roller with a horizontal axis, on which the U-shaped bottom of the gutter runs and rests.

10. A sorting device according to claim 8, characterized in that it includes at least one driving roller, which runs on the wall of the annular gutter, against which it is kept applied by elastic return means.

11. A sorting device according to claim 8, characterized in that the enclosure is integral with an air generator constituted by a blower, the turbine of which is coaxial with the vertical axis of rotation of the enclosure, said turbine being driven by means of a fixed engine to the output shaft of which it is connected by a belt drive, said turbine being housed in a stator contained in the space between the two central horizontal plates of the enclosure, said space opening at its periphery into the space defined under the porous bottom of the enclosure for supplying the latter with compressed air.

12. A sorting device according to claim 1, characterized in that there are provided at least two concentric circular baffles, which are integral with either of the inner surfaces of the central horizontal plates of the enclosure, so that the air zigzags from the center between said plates, whereby its pressure is suitably distributed.

13. A sorting device according to claim 11, characterized in that at least one of the central horizontal plates is provided with ports which are adapted to be obturated, the extent of obturation of said ports adjusting the air flow rate.

14. A sorting device according to claim 1, characterized in that each paddle wheel has an annular side face against which a driving roller runs, the fixed support of said roller being adapted to occupy a position adjustable with respect to the axis of the paddle wheel, so that, with a driving roller which turns at a constant speed, it is possible to vary the speed of rotation of the paddle wheel continuously.

15. A sorting device according to claim 1, characterized in that the elements of the diffuser are balls which have all the same diameter, such as steel balls 1 mm in diameter.

16. A sorting device according to claim 1, characterized in that the elements of the diffuser are:

a first class of big balls, all of which have the same diameter (for instance, steel balls 1 mm in diameter);

a second class of small balls, all of which have the same, definitely smaller, diameter (for instance, steel balls 0.10 mm in diameter).

17. A sorting device according to claim 1, characterized in that the diffuser is constituted by several superposed layers of balls, the balls in each layer having all the same diameter, but the diameters of the balls decreasing progressively from the lower layers to the upper layers (for instance, steel balls, the diameters of which are:

1 mm in the layers at the bottom of the gutter;

0.6 mm in the next upper layers;

0.4 mm in the layers which overlie said next upper layers;

0.2 mm in those upper layers which define the top of the fluidized bed).

18. A sorting device according to claim 1, characterized in that it includes at least one paddle wheel which turns about a coaxial fixed cylinder which is provided with an opening at its upper part, while an Archimedean screw is rotatably integral with said wheel and innerly tangential to said cylinder, so that the bodies picked up from the fluidized bed are discharged into said cylinder, and carried away by the Archimedean screw in a direction parallel to the axis of the paddle wheel.

* * * * *